US006474046B1

(12) United States Patent
Ours et al.

(10) Patent No.: US 6,474,046 B1
(45) Date of Patent: Nov. 5, 2002

(54) METHOD OF INDUCTION SEALING LINERS TO CARTONS

(75) Inventors: David C. Ours, Marshall, MI (US); Michael Borgerson, Battle Creek, MI (US); David L. Bradley, Battle Creek, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 79 days.

(21) Appl. No.: 09/699,300

(22) Filed: Oct. 27, 2000

Related U.S. Application Data

(63) Continuation of application No. 09/213,100, filed on Dec. 17, 1998, which is a continuation-in-part of application No. 09/150,966, filed on Sep. 10, 1998, now Pat. No. 6,145,736, which is a continuation-in-part of application No. 09/050,533, filed on Mar. 30, 1998, now Pat. No. 6,062,467.

(60) Provisional application No. 60/069,859, filed on Dec. 17, 1997.

(51) Int. Cl.[7] ..... B65B 31/02

(52) U.S. Cl. ..... 53/432; 53/434; 53/449; 493/93

(58) Field of Search ..... 53/432, 434, 449, 53/510, 512; 493/93, 95, 907

(56) References Cited

U.S. PATENT DOCUMENTS

| | | | | |
|---|---|---|---|---|
| 3,390,618 | A | * | 7/1968 | McArdle |
| 3,715,853 | A | * | 2/1973 | Bemiss |
| 3,955,006 | A | * | 5/1976 | Sokolsky et al. |
| 4,949,527 | A | * | 8/1990 | Boeckmann et al. |
| 5,735,786 | A | * | 4/1998 | Krueger et al. |
| 6,216,943 | B1 | * | 4/2001 | Ryan |
| 6,234,386 | B1 | * | 5/2001 | Drummond et al. |

* cited by examiner

*Primary Examiner*—Eugene Kim
(74) *Attorney, Agent, or Firm*—Howard & Howard

(57) ABSTRACT

Processes for preparing cartons, including bag in the box type cartons, using inductive heating are disclosed. Methods for preparing bowl-type single serving containers having filled bags therein and methods for using inductive heating to bond pour spouts to cartons are also disclosed.

15 Claims, 4 Drawing Sheets

METHOD OF INDUCTION SEALING LINERS TO CARTONS

RELATED APPLICATION DATA

This application is related to application Ser. No. 09/213,100 filed Dec. 17, 1998, which is a continuation-in-part of application Ser. No. 09/150,966 filed Sep. 10, 1998, now U.S. Pat. No. 6,145,796 which is a continuation-in-part of application Ser. No. 09/050, 533 filed Mar. 30, 1998, now U.S. Pat. No. 6,062,467 which claims priority from provisional application Serial No. 60/069,859 filed Dec. 17, 1997, each of which are incorporated herein by reference.

BACKGROUND

This invention relates to the packaging of dry particulate foods such as ready-to-eat ("RTE") cereal. More specifically, this invention relates to production of bagin-a-box cartons using induction heating.

Cartons for dry particulate products such as RTE cereal are usually formed from a blank of paperboard or similar material comprising sidewalls with top and bottom flaps. The liner is a plastic or coated paper bag to preserve the particulate product. The liner can be filled and sealed before or after being placed inside an open carton, the flaps of which are then folded and sealed.

In U.S. patent application Ser. No. 09/213,100 filed Dec. 17, 1998, the use of induction heating and a vacuum is disclosed to seal a filled and sealed liner along weakened seal or tear lines without breaking the seal of the liner to a dispensing panel or door forming a dispensing opening. The present application is directed to other applications of the technology described in the '100 application to prepare alternative containers and other products, including, e.g., single-serving type containers.

SUMMARY

The present invention is directed towards a method for affixing filled and sealed liner bags in bag-in-box cartons wherein the liner is filled and sealed before being inserted into the carton and is thereafter induction sealed to the interior of the carton without breaking the seal of the liner. The carton may be open or sealed when the liner is adhered to the carton interior. Preferably a weakened tear line is formed in the liner corresponding to a pour spout or opening of the carton so that upon initial opening, the liner separates from the reminder of the liner along the weakened tear line to provide access to the contents of the carton.

Cartons made according to the invention have a filled and sealed liner which contacts an adhesive that is activated in situ by induction heating, preferably under vacuum, such that the liner adheres to the interior of the carton or a selected portion or portions thereof without breaking the seal of the liner.

The present invention is also directed to single serving "bag-in-bowl" containers, having a filled and sealed bag that is adhesively bonded to a rim or peripheral edge of a disposable bowl made of paper, cardboard or plastic. The bag-in-bowl is made in a manner similar to the process described above in that it relies on induction heating to bond the bag to the bowl using a heat activated adhesive without breaking the seal of the bag.

BRIEF DESCRIPTION OF THE DRAWINGS

The present invention is more fully understood from the following description and the accompanying drawings wherein.

DESCRIPTION

According to the present invention, a filled and sealed liner or bag is bonded to a side panel or panels and/or end wall or walls of a carton blank without breaking the seal of the liner. One purpose is to maintain the bag in a fixed position relative to the carton after it is opened and he bag seal broken to gain access to the contents. The liner bag is formed, filled and sealed using means known in the art.

Prior attempts to affix a filled and sealed lines to a carton interior after insertion of the liner have led to inconsistent results and have interfered with the insertion of the filled liner into the carton.

Figure 2:
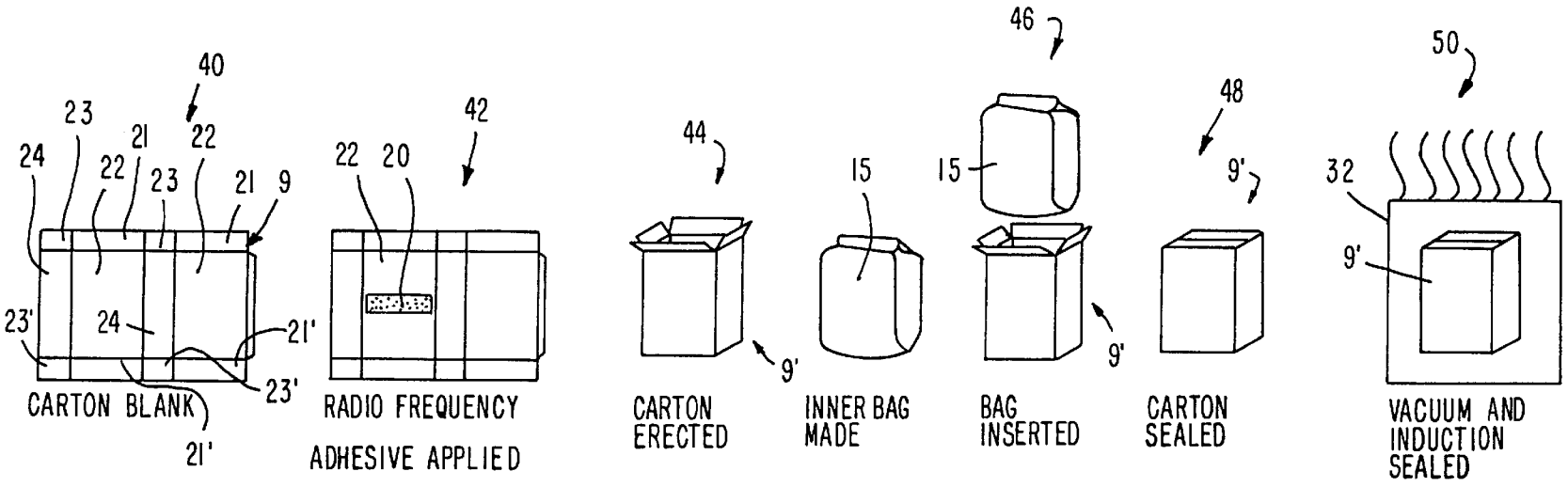
FIG. 2 is a flow diagram of a method to affix the liner of a bag-in-box carton to the carton interior.

FIG. 2 is a flow diagram of the general process for preparing the cartons of the invention. The method begins by providing a carton blank 9 in step 40. Blank 9 is conventional and has side panels 22, end panels 24 and corresponding top flaps 21 and 23 and bottom flaps 21' and 23'. A strip of a radio frequency adhesive 20 is applied in step 12 to a transverse section of side panel 22 of blank 9. An RF adhesive useful herein is normally untacky but activated into an adhesive state when heated remotely by RF heating.

Carton 9 is then erected in step 44 leaving one end open to receive a filled and sealed bag 15 which is separately prepared as is known in the art. Filled and sealed bag is inserted into the open end of erected carton 9 which is closed and sealed in step 46. The sealed carton is then introduced into an induction heating chamber in step 20, where the carton is exposed to induction (RF) heating under vacuum and conditions such that the bag expands and contacts the side walls of the carton. The sealed bag contains air at ambient pressure which causes the bag to expand and press against the carton in a low pressure environment. The application of radio frequency activates adhesive strip 20 to therapy bonding and affixing the bag to the carton interior without breaking the seal of the bag 15. Alternatively, the bonding energy may be applied to activate the adhesive and bond the liner to the carton prior to sealing the carton, with the carton being sealed thereafter.

Known RF activatable adhesives can be used as well as known vacuum chambers and induction heating units or devices. Suitable adhesives include known hot melt adhesives that are not tacky at ambient temperatures so as to not interfere with liner insertion.

A preferred multi chamber device with intake and discharge locks for handling (sealing) cartons on a high-speed continuous basis is disclosed in copending application Ser. No. 09/213,100 filed Dec. 17, 1998, which is incorporated herein by reference.

RF adhesive can be applied in any desired pattern such as strips, dots, squares and the like to the side and/or end walls of blank 9 or to the entire area of the side and end walls 22 an 24 (reference number 28, FIG. 3) to create a linerless-type carton normally obtained by laminating or coating stock before cutting blanks. RF adhesive can also be applied to bag 15 with or without adhesive applied to the interior of blank 9.

The amount and location of the adhesive will be determined in part by the contents of the carton and the intended use of the carton. An RTE cereal liner can be affixed with a strip 20 as shown in FIG. 2 to maintain bag 15 upright in the carton after opening. One or more strips or dots will be sufficient in the case of light contents like RTE cereal whereas more dots, strips or a full coating of adhesive may be needed for heavier contents such as pet foods, soaps or lawn care products. The invention is especially useful for maintaining liner alignment when a pour spout is employed as disclosed in U.S. Ser. No. 09/213,100 filed Dec. 17, 1998.

Figure 1:
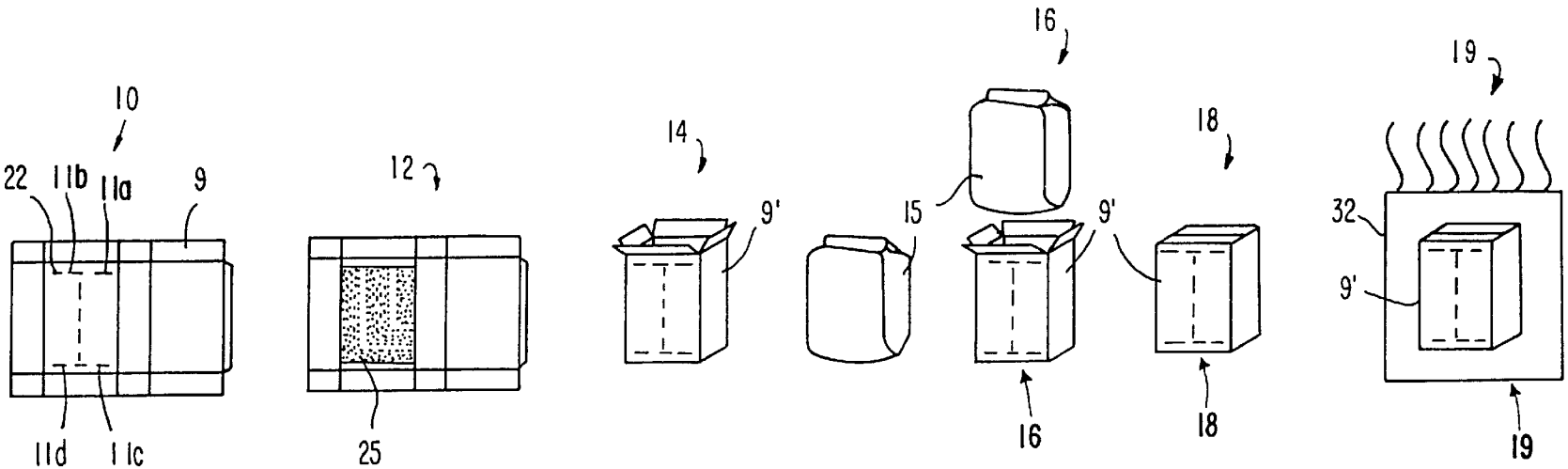
FIG. 1 is a flow diagram showing an embodiment for preparing a single serving, bag-in-box carton having perforated flaps in a side wall that fold out to provide access to the contents of the bag.

FIG. 1 shows an embodiment wherein a known single serving bag-in-box type carton having perforated access flaps 11*a* and 11*b* in a side wall of blank 9 is prepared with a radio frequency adhesive applied to the flaps 11*a* and 11*b* and to an adjacent area of the inner side wall 22 of blank 9. The carton is then erected in step 14, leaving the top open to receive a filled and sealed single serving bag 15 in step 16. The carton is sealed step 18 and is then introduced into an induction heating unit 32 under vacuum. The vacuum causes the bag 15 to expand and contact the adhesive area 25 which is activated by induction heating therapy bonding the bag to flaps 11*a* and 11*b* and to adjacent areas of side panel 22.

Figure 3:
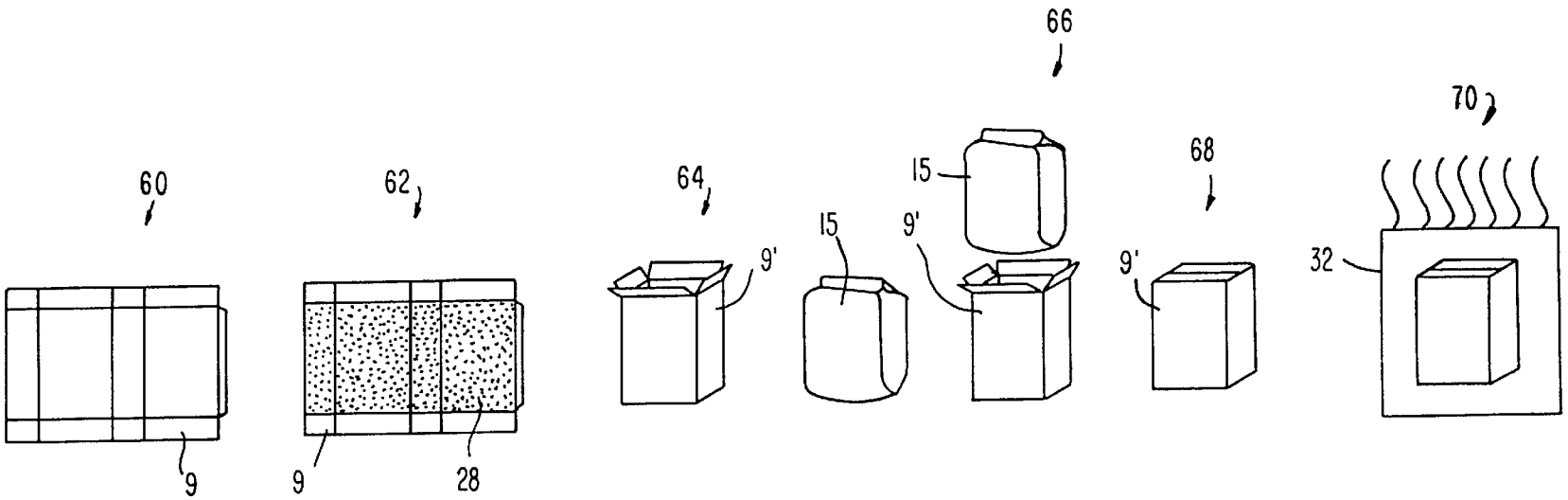
FIG. 3 is a flow diagram an alternative method to affix the liner of a bag-in-box carton to the carton interior.

In FIG. 3, RF adhesive 28 is applied to substantially the entire inner surface of the carton blank 9 in step 62. The carton is then erected in step 64, and the separately prepared filled and sealed liner bag is inserted into the erect carton through an open end thereof in step 66. As before, the carton is sealed in step 68 and introduced into an induction sealer as described above.

Figure 4:
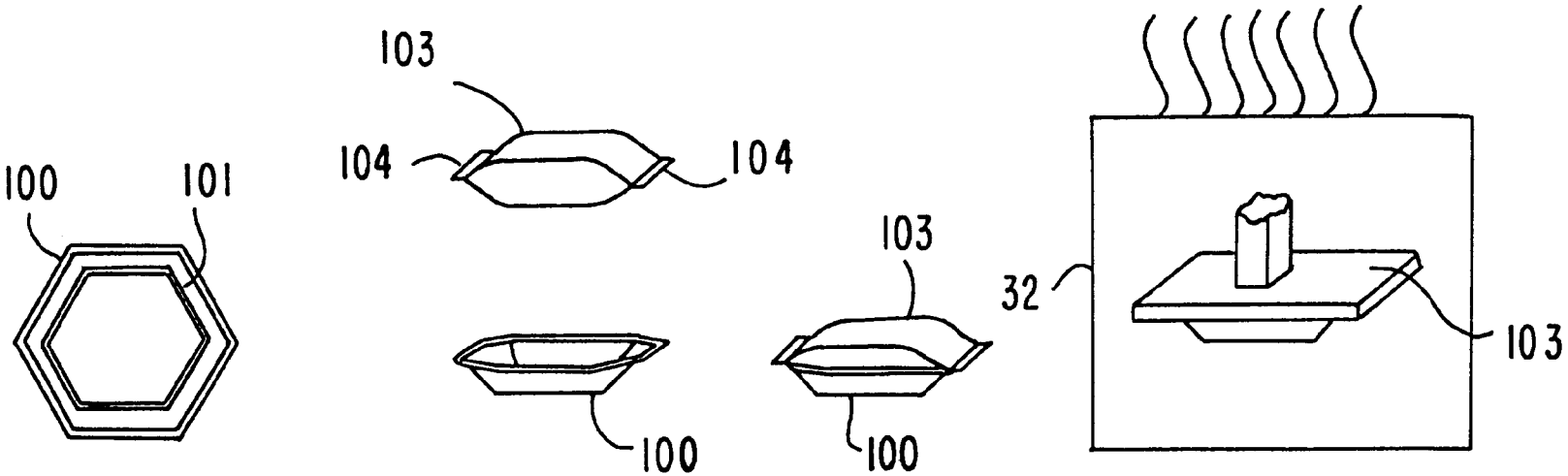
FIG. 4 is a flow diagram of a method for preparing a bag-in-bowl carton according to the invention.

FIG. 4 shows a "bag-in-bowl" useful for single or multiple servings. A six-sided bowl 100 made of paper, plastic, composite or other suitable disposable material has a peripheral lip or rim 101 on which an RF adhesive or other activatable adhesive is applied. The RF adhesive may also be applied to an interior region of bowl 100. A sealed and filled bag 103 is positioned on bowl 100 in such a manner that the end seams 104 of bag 103 contact the adhesive on rim 101 and/or bowl 100. Pressure is applied to the bag, e.g. by a plunger 103 in unit 32 to compress the bag so that end seams 104 contact the adhesive areas. While pressure is applied, the adhesive is inductively heated or otherwise activated to bond end seams 104 to the bowl.

Liner bags used with the products of the invention can be prepared and filled by any means known in the art. For example, liner material is cut into sized sheets, wrapped around a mandrel and longitudinally and transversely sealed before and after filling.

In an alternative embodiment, the bowl may be filled with the desired contents and a liner placed over the bowl and bonded thereto using the techniques described above.

Multiple activatable adhesive systems such as hot melt (which might further employ any variety of heating methodologies such as conduction, convection, or by activation with electromagnetic or sonic energy) as well as RF induction heating may be used to prepare the bag and to adhere the filled bag to the back of carton.

Hot-melt adhesives are 100% solids and are applied in hot, molten form. They set fast when heat is removed and can be preapplied and reactivated later by the application of heat. Hot melt adhesives are typically formulated with a backbone polymer such as ethylene-vinyl acetate or polyethylene. The main polymer is usually let down with a diluent such as wax to improve melt flow properties. Antioxidants may be added since the adhesive is applied hot and is subject to oxidation. Tackifiers can also be added to improve hot tack and viscosity. Other materials can be added to influence the melt temperature, and colorants may be added to make the adhesive more visible.

Hot-melt adhesives are readily available from numerous sources. INSTANT LOK® hot melt adhesives from National Starch and Chemical Corporation of Bridgewater N.J. 08807 are suitable for use in the invention.

In a preferred embodiment, the hot melt adhesive is activated by induction heating. In this embodiment, an activatable hot melt adhesive is applied to the carton interior and/or the bag and heat is applied to the interface between the liner and the carton such as by induction heating after creating or forcing contact at the interface by employing a vacuum and/or compressing the filled and sealed bag. Such a bag normally has "head space" created by under filling a bag which allows the bag to be compressed without crushing the contents.

Activation of the hot melt adhesive can also be accomplished by inclusion of a heat generating substance in or positioned such that the hot melt adhesive to generate the heat necessary to activate the hot melt adhesive to bond the liner to the carton. Such heat generating substances include metal foils such as aluminum foil, which may be laminated on one or both sides to a hot melt adhesive, metal salts such as magnesium chloride, chromium nitrate, aluminum chloride and the like, which are mixed with the hot melt adhesive; and metal particles such as iron or aluminum powder mixed with or flocked onto the hot melt adhesive applied to the carton interior and/or bag.

When using magnetic particles such as iron, a magnet can be employed to orient the particles and promote bonding with the liner. The metal salts and metal particles are used in amounts sufficient to activate the adhesive when external bonding energy is applied.

Metal foil laminates are easy to apply and activate. A typical metal foil laminate includes aluminum foil, generally vacuum metalized aluminum on a polyester film, with a linear low density polyethylene adhesive on one or both sides. Curwood Inc., of Oshkosh, WI. 54903, provides CURLAM® Grade 5432 film which has an adhesive on one side of the film. It is preferred to coat both sides of the film with an adhesive which enables the use of induction heating to bond the foil laminate to the carton and the liner at the same time. The metal foil laminate is preferably aligned corresponding to an area of the carton that will be opened for use, e.g., along a perforated access panel, so that when the liner bonds to the foil laminate a weakened tear line is formed in the liner corresponding to the carton opening. The weakened tear line allows for easy access to the carton contents while maintaining a seal prior to opening. Upon initial opening, the liner will separate along the weakened tear line to allow access to the inner contents.

Induction heating equipment is widely used in the packaging field and suitable units for use in the invention are available from Lepel Corporation of Edgewood, N.Y. 11717 and Amertherm, Inc. of Scottsville, N.Y. 14546.

The intensity and duration of the induction field required to bond the liner to the carton depends on the composition of the heat activatable adhesive. For example, an aluminum foil laminated with linear, low density polyethylene generally achieves its sealing temperature in 0.9 to 1.2 seconds when exposed to a Lepel, LEPAK, Jr. 750 watt induction sealer. An adhesive having a resin base including about 5 to 10 weight percent metallic salt, such as chromium nitrate or aluminum chloride, generally reaches its sealing temperature in under 2.0 seconds when placed in an 800 watt GE microwave oven operating at 900 to 1100 kHz.

Other induction heating systems and heat activatable adhesives can be used. For example, an induction heating system for sealing packages using magnetic susceptible particles and heat softenable adhesives and high frequency alternating magnetic fields is disclosed in U.S. Pat. No. 3,879,247 which is incorporated herein by reference. Polymer systems for sealing containers which can be activated by electromagnetic energy frequencies of 0.1–30,000 MHZ, including radio frequency and microwave heating, are disclosed in U.S. Pat. No. 4,787,194 which is incorporated herein by reference. RF sealable, non-foil acrylate based polymers for packaging applications are disclosed in U.S. Pat. No. 4,660,354 and WO 95/03939 which are also incorporated herein by reference.

It is particularly advantageous to use the invention along with a pour spout as disclosed in copending application Ser. No. 09/213,100 filed Dec. 17, 1998, wherein heat sealing a liner to a flap or front panel of a pour spout locally weakens the liner to facilitate separation of a portion of the liner upon initial opening of the pour spout or flap. In one embodiment, this can be accomplished by attaching a metal foil laminate to the front panel of the pour spout or to a fitment which defines the dispensing opening. The foil can be configured so as to concentrate heat at the edges of the dispensing opening which crates a weakened or thinned tear line without breaking the seal of the bag.

A preferred liner is biaxially oriented, laminated high density polyethylene film. Such films will tear easily in the longitudinal or machine direction and to impart better tearability in the transverse direction, fillers such as finely divided calcium carbonate, silica, diatomaceous earth and the like can be added to the film. A suitable film can have two high density polyethylene layers containing 15% by weight finely divided silica in the inner layer and 10% in the outer layer.

We claim:

1. A process for affixing a filled and sealed liner bag in a bag-in-box type carton for particulate product without breaking the seal of the liner bag; said process comprising the steps of:

applying an activatable, nontacky adhesive to at least one of an interior of the carton and an exterior of the liner bag;

inserting the filled and sealed liner bag into the carton;

closing and sealing the carton over the filled and sealed liner bag;

applying at least one of vacuum and pressure to the carton after closing and sealing the carton to cause the liner to contact the adhesive at an interface with the interior of the carton; and activating the activatable, nontacky adhesive after closing and sealing the carton thereby bonding the liner to the carton without breaking the seal of the liner.

2. Process of claim 1, wherein said adhesive is applied as a strip to a side wall of said carton.

3. Process of claim 1, wherein said adhesive is applied to a plurality of side wall interior surfaces of said carton.

4. Process of claim 1, wherein the step of activating the adhesive includes exposing the closed and sealed carton to radio frequency waves.

5. Process of claim 1, wherein the step of activating the adhesive includes heating the closed and sealed carton.

6. A process for affixing a filled and sealed liner bag in a bag-in-box type single-serving carton for particulate product without breaking the seal of the liner bag; said process comprising the steps of:

applying a heat activatable, nontacky adhesive to at least one of an interior of the single-serving carton and an exterior of the liner bag, the carton interior having perforated access flaps defining an access area to the carton interior;

inserting the filled and sealed liner bag into the single-serving carton;

closing and sealing the single-serving carton over the filled and sealed liner bag;

applying at least one of vacuum and pressure to the single-serving carton after closing and sealing the single-serving carton to cause the liner to contact the adhesive at an interface with the interior of the single-serving carton; and activating the adhesive by heating after closing and sealing the single-serving carton thereby bonding the liner to the single-serving carton and forming a weakened tear line in the liner corresponding to the perforated access flaps.

7. Process of claim 6, wherein said adhesive is also applied as a strip to a side wall of said carton that does not have said perforated access flaps.

8. Process of claim 6, wherein the step of activating the adhesive is further defined as exposing the closed and sealed carton to radio frequency waves to heat the adhesive.

9. A process for affixing a filled and sealed liner bag to a bowl in a bag-in-bowl type carton for particulate product without breaking the seal of the liner bag; said process comprising the steps of:

applying a heat activatable, nontacky adhesive to at least one of an interior of the bowl or a bowl rim and an exterior of the liner bag;

inserting the filled and sealed liner bag into the carton;

closing and sealing the carton over the filled and sealer liner bag;

applying at least one of vacuum and pressure to the carton after closing and sealing the carton to cause the liner to contact the adhesive; and heating the adhesive after closing and sealing the carton thereby bonding the filled liner to the bowl without breaking the seal of the liner.

10. Process for affixing a filled and sealed liner bag to the dispensing assembly of a bag-in-box type carton without breaking the seal of the filled liner; said process comprising the steps of:

applying a heat activatable, nontacky adhesive to at least one of an interior of a carton having a dispensing flap and an exterior of the liner bag;

inserting the filled and sealed liner bag into the carton;

closing and sealing the carton over the filled and sealed liner bag;

applying at least one of vacuum and pressure to the carton after closing and sealing the carton to cause the liner to contact the adhesive at an interface with the interior of the carton; and heating the adhesive after closing and sealing the carton thereby bonding the liner to the carton without breaking the seal of the liner;

said filled liner being bonded to said flap along a weakened tear line without breaking the seal of the liner whereby upon initial opening of the flap that portion of the liner bonded thereto separates from the liner along the weakened tear line thereby providing access to the contents of the carton.

11. A process for affixing a filled and sealed liner bag in a bag-in-box type carton for particulate product without breaking the seal of the liner bag; said process comprising the steps of:

forming the carton having top flaps, bottom flaps, and side panels defining an interior between the flaps;

applying an activatable, nontacky adhesive to at least one of an interior of the carton and an exterior of the liner bag;

closing and sealing the bottom flaps;

inserting the filled and sealed liner bag into the carton through the top flaps;

applying at least one of vacuum and pressure to the carton to cause the liner to contact adhesive at an interface with the interior of the carton while the top flaps remain open;

activating the activatable, nontacky adhesive thereby bonding the liner to the carton without breaking the seal of the liner such that liner is secured to the carton while the top flaps remain open; and closing and sealing the top flaps of the carton over the filled and sealed liner bag after the liner bag has been bonded to the carton.

12. A process as set forth in claim 11, wherein the step of activating the adhesive includes exposing the carton to radio frequency waves such that the adhesive bonds the liner to the carton.

13. A process as set forth in claim 11, wherein the step of activating the adhesive includes heating the carton such that the adhesives bonds the liner to the carton.

14. A process for affixing a filled and sealed liner bag in a bag-in-box type single-serving carton for particulate product without breaking the seal of the liner bag; said process comprising the steps of:

forming the single-serving carton having top flaps, bottom flaps, and side panels defining an interior between the flaps such that the side panels have perforated access flaps defining an access area to an interior of the carton;

applying an activatable, nontacky adhesive to at least one of the interior of the single-serving carton and an exterior of the liner bag;

closing and sealing the bottom flaps;

inserting the filled and sealed liner bag into the single-serving carton through the top flaps;

applying at least one of vacuum and pressure to the single-serving carton to cause the liner to contact the adhesive at an interface with the access flaps of the single-serving carton while the top flaps remains open;

activating the activatable, nontacky adhesive thereby bonding the liner to the single-serving carton without breaking the seal of the liner such that liner is secured to the single-serving carton while the top flap remains open and forming a weakened tear line in the liner corresponding to the perforated access flaps; and closing and sealing the top flaps of the single-serving carton over the filled and sealed liner bag after the liner bag has been bonded to the single-serving carton.

15. A process as set forth in claim 14, wherein the step of activating the adhesive is further defined as exposing the carton to radio frequency waves to activate the adhesive.

* * * * *